US005997712A

United States Patent [19]

Ting et al.

[11] Patent Number: 5,997,712

[45] Date of Patent: Dec. 7, 1999

[54] COPPER REPLENISHMENT TECHNIQUE FOR PRECISION COPPER PLATING SYSTEM

[75] Inventors: Chiu H. Ting, Saratoga; Peter Cho, Los Angeles; Frank Lin, Fremont; Tanya Andryushchenko, Cupertino, all of Calif.

[73] Assignee: Cutek Research, Inc., San Jose, Calif.

[21] Appl. No.: 09/050,769

[22] Filed: Mar. 30, 1998

[51] Int. Cl.[6] ..... C25D 21/18

[52] U.S. Cl. ..... 205/101; 205/291

[58] Field of Search ..... 205/291, 101; 204/232, 237, 240, 238; 118/603, 610

[56] References Cited

U.S. PATENT DOCUMENTS

| | | | |
|---|---|---|---|
| 3,649,509 | 3/1972 | Morawetz et al. | 204/238 |
| 4,324,623 | 4/1982 | Schaer . | |
| 4,692,222 | 9/1987 | Pelligrino et al. | 204/15 |
| 4,961,845 | 10/1990 | Dawson et al. | 210/85 |
| 5,332,485 | 7/1994 | Thompson | 204/302 |
| 5,344,491 | 9/1994 | Katou | 118/695 |
| 5,516,414 | 5/1996 | Glafenhein et al. . | |
| 5,573,652 | 11/1996 | Kiyama et al. | 205/98 |
| 5,609,747 | 3/1997 | Sakurai et al. . | |

*Primary Examiner*—Arun S. Phasge
*Assistant Examiner*—Erica Smith-Hicks
*Attorney, Agent, or Firm*—Blakely, Sokoloff, Taylor & Zafman

[57] ABSTRACT

A copper replenishment system for replenishing copper which is depleted from a copper plating solution. The replenishment is achieved by the use of a compact filter cartridge, which is inserted into a recirculating loop for the solution. The filter cartridge contains a chemical, which when reacting with the solution replenishes the copper into the solution. The filter cartridge is a compact unit which can be easily handled and reduces the amount of contaminants that could be introduced by the presence of the replenishment chemical.

24 Claims, 4 Drawing Sheets

COPPER REPLENISHMENT TECHNIQUE FOR PRECISION COPPER PLATING SYSTEM

BACKGROUND OF THE INVENTION

1. Field of the Invention

The present invention relates to the field of copper plating systems and, more particularly, to a technique for replenishing copper in a plating solution.

2. Background of the Related Art

Plating systems, in which an object is immersed in a plating solution to plate metal onto the object, are well known in the art. A variety of metals can be plated by simple immersion or electroplated when electrodes are introduced in the solution. In copper plating, a plating solution such as a mixture of copper sulfate ($CuSO_4$) and sulfuric acid ($H_2SO_4$) is used as the source of copper to plate copper onto an object. Typically, a cathode is connected to the object that is to be plated (so that the object functions as the cathode electrode) and a potential is placed across the cathode and an anode. Copper ions in the solution will then be reduced onto the cathode electrode (namely, the object to be plated).

In the traditional copper plating approach, the anode electrode is usually made of copper which dissolves into the plating solution to replace the copper ions as the copper ions are depleted. However, for precision plating, inert anodes are utilized so that the anode does not change shape during the plating process. Instead of the copper ions being oxidized from the anode material, some other source of copper is needed. In this instance, copper containing material is introduced into the plating solution. That is, some external source is used to replenish copper ions in the solution as the copper ions are depleted from the solution due to the plating action.

A number of copper replenishing techniques are known in the art. See for example, U.S. Pat. Nos. 4,324,623; 5,516,414; and 5,609,747. However, the known replenishment techniques generally rely on the introduction of copper sourcing materials, such as $CuSO_4$ and $Cu(OH)_2$, into the liquid bath. In some instances, an intermediary container (or bath) is utilized so that the copper sourcing material is not simply dumped into the solution.

Although this technique is adequate and acceptable for most general plating applications, it is not necessarily desirable where a very clean environment is desired. For example, in the fabrication of integrated circuits on semiconductor wafers (such as a silicon wafer), it is not desirable to have contaminant particulates in the cleanroom where the devices are manufactured. Since in many applications the copper sourcing material is in powder or granular form, the contamination factor is very high when these materials are present in the cleanroom. Similarly, any undissolved particles, from the addition of solid material into the solution, may have detrimental impact on the wafer being plated. Accordingly, it is appreciated that an improved approach to introduce copper sourcing material into a copper plating solution is desirable.

SUMMARY OF THE INVENTION

The present invention describes a replenishment system for replenishing a plating material which is depleted from a solution during a plating process. The replenishment is achieved by the use of a compact cartridge, which is inserted into a recirculating loop for the solution. The replenishment system generally has a vessel for holding the plating solution and the loop for recirculating the solution. Within that loop is inserted a container (canister) holding the material replenishment cartridge. The cartridge contains chemicals, when reacting with the solution, will introduce the plating material into the solution to bring the plating material concentration level to a desired level.

The cartridge is a porous filter assembly having a hollow core. The chemical utilized for replenishing the plating material is contained in the filter element. The filter cartridge holds the chemical in a contained unit during transport, handling and storage of the cartridge. The plating material is released only when the chemical reacts with the plating solution. The unitary packaging and simplicity allows the replenishment chemical to be introduced into the plating system, by simple insertion of the cartridge into the system. Furthermore, the cartridge is simply replaced when the chemical in the filter is exhausted.

In the preferred embodiment, the invention is used to replenish copper in a copper plating system. The system is used for plating copper onto semiconductor wafers. Although a variety of copper replenishing chemicals can be used, the filter cartridge of the preferred embodiment uses copper oxide or copper hydroxide to replenish copper ions into the plating solution.

In the preferred embodiment, a sensor is used to monitor the concentration level of the copper in the solution and valves insert the filter cartridge into the recirculation loop when the copper concentration falls below a preset level. The sensor can be a device to monitor the ampere-minutes (or coulombs) used in the plating process or it can be a variety of other sensors for monitoring plating parameters. In an alternative embodiment, a processor is used to automatically monitor and adjust the concentration level of the copper in the plating solution as needed.

DETAILED DESCRIPTION OF THE INVENTION

A technique for replenishing copper for use in a copper plating system is described. In the following description, numerous specific details are set forth, such as specific chemicals, structures, materials, processes, etc., in order to provide a thorough understanding of the present invention. However, it will be appreciated by one skilled in the art that the present invention may be practiced without these specific details. In other instances, well known techniques, structures and chemistry have not been described in detail in order not to obscure the present invention.

It is to be noted that the preferred embodiment of the invention is described in reference to copper replenishment for a copper plating system and in which copper oxide or copper hydroxide is utilized to replenish the copper ions in the solution. However, it is appreciated that the practice of the present invention can be achieved with other copper replenishing chemicals and is not limited to copper oxide or copper hydroxide. Furthermore, the present invention can be readily adapted for use in the plating of other metals and is not limited to the plating of copper.

Figure 1:
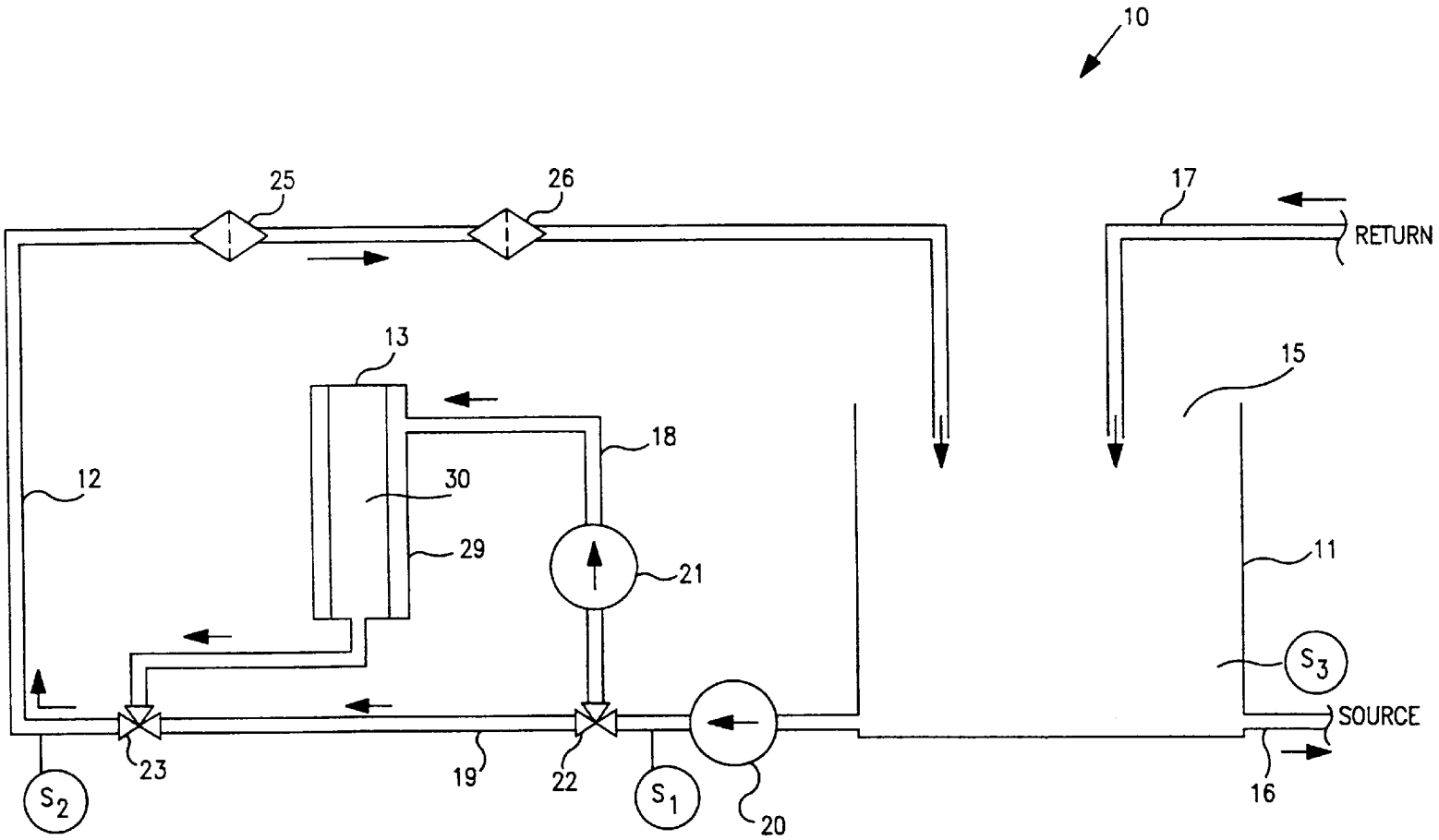
FIG. 1 is a schematic diagram of a plating replenishment system of the present invention.

Referring to FIG. 1, a copper replenishment system 10 of the present invention is shown. System 10 is comprised of a vessel 11, recirculation loop 12, copper replenishment source 13 and a variety of pumps, valves and filters for recirculating a plating solution 15. The vessel 11 can be a tank, container, or any other housing which is generally used for holding a liquid plating solution. In this instance, vessel 11 holds the copper plating solution 15. The particular chemistry of the plating solution 15 will depend on the plating process being performed.

The vessel 11 can be utilized for the plating process itself, in which case the object being plated is placed within vessel 11. Although not shown, electrodes for electroplating copper can also be introduced into the vessel 11. Alternatively, the plating process can be performed external to the vessel 11. In this instance, the vessel 11 will function as a sourcing tank for the plating solution 15 and some form of coupling is used to transport the solution 15 to where the plating process is being performed.

In the example of FIG. 1, a feed-line 16 transports the solution 15 from vessel 11 to the plating location. For example, when the plating solution 15 is being utilized to plate copper onto a semiconductor wafer, the feed-line 16 transports the solution 15 to a processing chamber which deposits or plates copper onto the wafer. If the processing solution from the wafer processing chamber is to be recirculated, then a return line (shown as line 17) is used to return the liquid back into the vessel 11. It is appreciated that there are many applications in which the vessel can be used to hold or source the plating solution 15. The invention is not in the process being performed by the solution. Rather, the present invention is in the replenishment of copper, which is depleted from the solution 15 when the solution 15 is used to plate copper.

The recirculation loop 12 is used to draw a sample of the solution 15 from the vessel 11 and recirculate the solution 15 back into the vessel 11. Within this recirculation loop 12, the solution can follow either of two paths. A pump 20 pumps the solution 15 from the vessel 11 to a valve 22. The liquid path separates at this point and follows either a replenishment path 18 or a bypass path 19. The two paths 18 and 19 merge together again at a valve 23. A second pump 21 is included in the replenishment path 18 to pump the liquid through the copper replenishment source 13. However, it is appreciated that the second pump 21 is not necessary if the path 19 is completely shut-off, since the pump 20 will pump the liquid through the path 18. Accordingly, by corresponding operations of the valves 22 and 23, the liquid from the vessel 11 can be pumped through the replenishment path 18 or bypass it.

Also shown in FIG. 1 are filters and sensors which are typically utilized with the system 10. In the example, two filters 25 and 26 (one a pre-filter stage and the other a final filter stage) are utilized to filter the liquid. The actual number of filters employed is a design choice. The sensors are utilized to monitor the liquid at various stages and, accordingly, the use, location and number of such sensors is also a design choice dictated by the needs of the particular application. In the example, a sensor S1 is disposed to monitor the solution prior to the copper replenishment stage. Sensor S2 is disposed to monitor the liquid after the replenishment stage. Thus, the copper concentration of the liquid prior to and after being pumped through the copper replenishment source 13 can be monitored.

A third sensor S3 is also shown. The sensor S3 is disposed to monitor the solution in the vessel 11. It is appreciated that sensor S3 can provide the same function as the sensor S2. Furthermore, for simplicity, the copper ion concentration monitoring can be achieved more simply by the use of the sensor S3 only, if desired. What is important is that some form of monitoring is utilized to sense and monitor the concentration level of the copper ions in the solution 15 so that when required, additional copper can be added into the solution 15. It is appreciated that one sensor can be a device to monitor the ampere-minutes (or coulombs) used in the plating process. The amount of coulombs (or charge) can be directly translated into the amount of copper (grains or weight) depleted from the plating process. Again, the type of sensor employed is a design choice dependent on the plating process being practiced.

In the normal flow mode, the bypass path 19 is utilized for fluid flow. The liquid is monitored by the sensor(s) to track the amount of copper ions in the solution. When the copper concentration level drops below a certain preset value, the liquid is pumped through the replenishment path 18, so that additional copper ions can be introduced into the system.

It is also appreciated that in some instances, the processing flow loop (of lines 16 and 17) can be combined with the recirculating loop 12. In that instance, the plating solution 15 is distributed to the processing equipment after passing through valve 23 and the return line is coupled to the input of filter 25. That is, in the schematic of FIG. 1, the processing equipment is inserted in the loop 12 between the filters 25, 26 and the vessel 11. Accordingly, under normal processing operation, the bypass path 19 is used to supply the plating solution from the vessel 11 to the processing equipment. When the concentration level of the copper in the vessel falls below a preset value, the cartridge 30 is inserted in the loop to replenish the copper. The use of one or two circulating loops is a choice dictated more by the needs of the processing equipment and the process being performed.

The means for introducing additional copper ions is provided by the copper replenishment source 13. The present invention utilizes a replenishment cartridge 30, which is inserted into a container shell (or canister) 29. The inlet flow to the canister 29 is at the top and the outlet is at the bottom (preferably at the center), so that the plating liquid flows into the canister 29 along the periphery, traverses through the cartridge 30 and exits through the hollow central core (where the exit opening is located). A more detailed illustrations of the canister 29 and the cartridge 30 are shown in FIGS. 2 ad 3.

Figure 2:
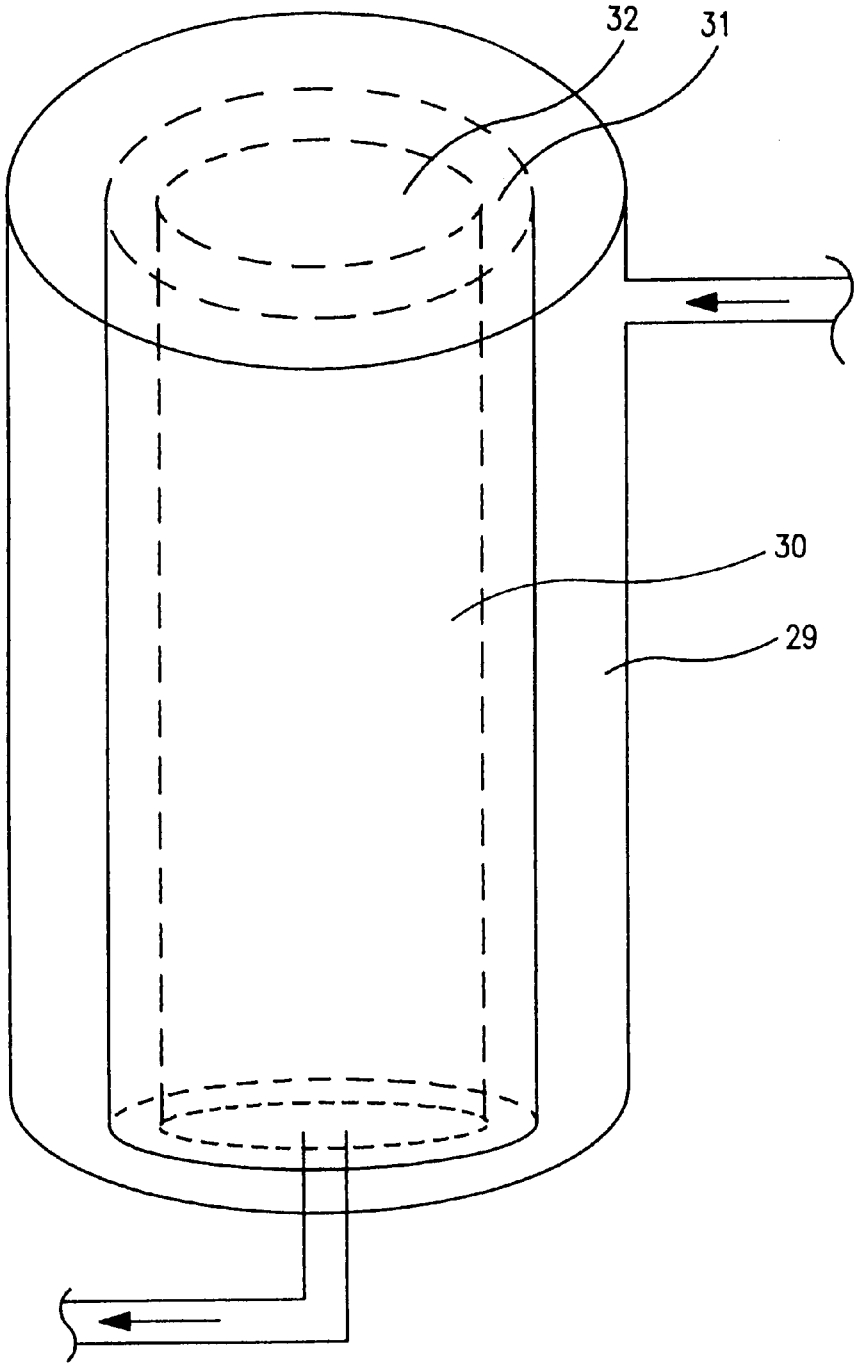
FIG. 2 is a pictorial diagram of a container shell and a filter cartridge, which cartridge is used to replenish the plating material back into a plating solution.
Figure 3:
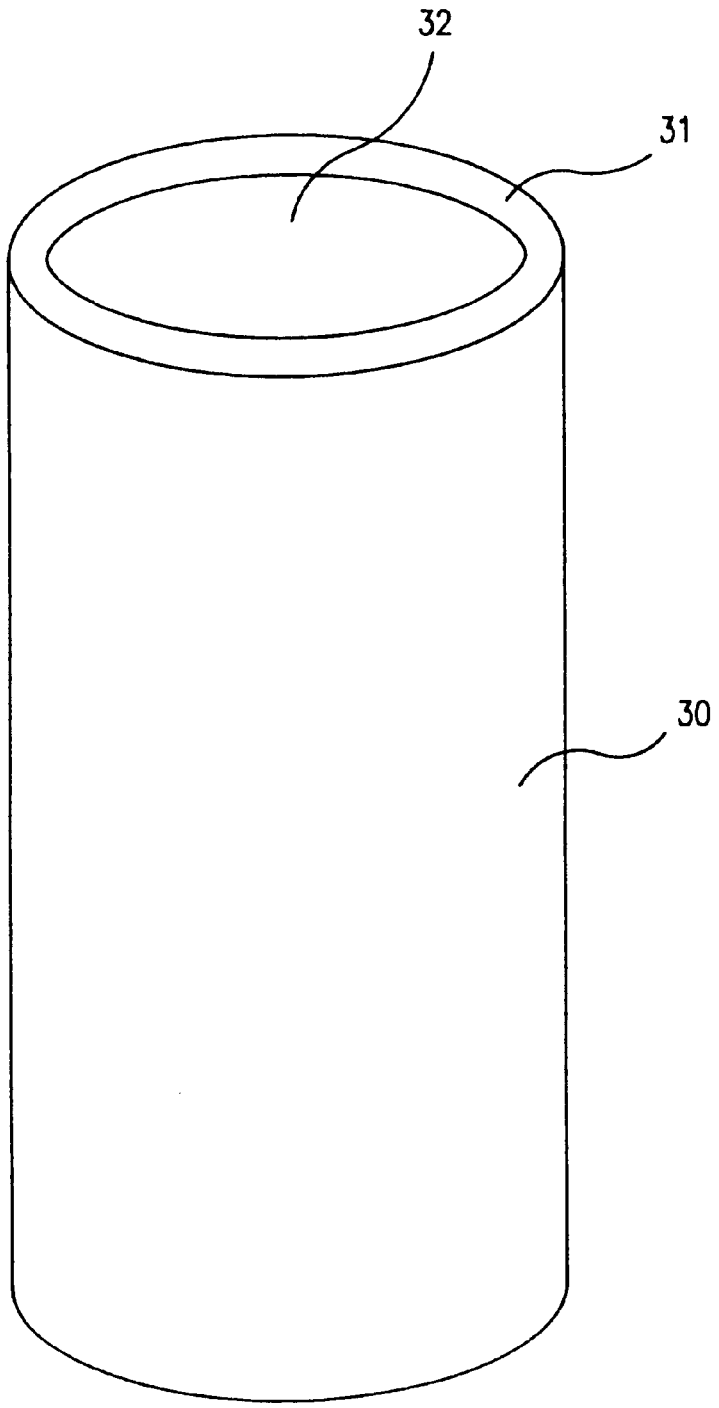
FIG. 3 is a detailed diagram of the filter cartridge shown in FIG. 2.

As shown in FIGS. 2 and 3, the cartridge 30 of the preferred embodiment is cylindrical in shape. It is understood that the shape of the cartridge 30 is a design choice. The cartridge 30 is comprised of an outer filter element 31 and an inner core 32. The filter 31 is filled with the necessary chemical to introduce the plating chemical (copper in the present context) into the liquid passing through the canister 29. The inner core 32 is left hollow (empty) so as to improve the fluid flow through the cartridge 30. The inner core 32 mates to the flow exit opening of the canister 29, so that the fluid flow through the filter is ensured.

The filter element 31 can be configured in several ways. Generally, it is formed from a porous material for permitting a liquid to flow through the filter. The filter may be configured as a dual-wall filter (having an outer and inner skin or structure) wherein the chemical resides between the two walls, or the filtration material can reside across the cross section, in which case the chemical is distributed within the filtration material. The top and the bottom of the cylinder is usually sealed (such as by the filtration material), typically where the replenishment chemical is in powder form. It is appreciated that the actual configuration of the filter 31 is a design choice. What is important is that some form of filtration is needed for the passage of the liquid and the replenishment chemical is distributed within the cartridge 30, so that as the liquid passes through the filter 31, the chemical is introduced into the solution.

Also, with the present invention, the cartridge 30 is manufactured as a packaged unit to provide convenience in handling. Because of its unitary packaging, the cartridge 30 can be transported and stored, until it is to be used. When ready for use in the system 10, the packaging is removed from the cartridge 30 and the cartridge 30 is inserted into the canister 29. Once in the canister 29 and sealed, the plating solution 15 flows into the canister to react with the chemical in the cartridge 30. Generally, it is preferred to have the cartridge 30 be of sufficient height, so that the two ends of the cartridge 30 seal against the bottom and top cover of the canister 29.

The chemical in the filter element 31 can be comprised of a variety of known chemicals which replenish copper ions into a plating solution. For example, the replenishment chemical can be copper hydroxide ($Cu(OH)_2$) or copper oxide (CuO). In the preferred embodiment, the core 31 is comprised of CuO. Accordingly, CuO in powder form is inserted to fill the open regions of the filter element 31. The top and bottom of the cartridge 30 are sealed so as to seal the CuO in the filter element 31.

Once the cartridge 30 is inserted into the canister 29, the plating solution 15 is made to flow into the canister when copper replenishment is desired. When the plating solution is comprised of a mixture of copper sulfate ($CuSO_4$) and sulfuric acid ($H_2SO_4$), the copper oxide will react in the solution by the chemical reaction $$CuO+2H^{+}\rightarrow Cu^{++}+H2O$$

to introduce copper ions back into the solution to replenish the depleted copper.

A significant advantage is obtained by the use of the cartridge 30 of the present invention. The compact packaged unit can be easily transported, handled and stored as a packaged unit, unlike the bulk chemicals currently in use. The cartridge 30 can be easily inserted into system 10 and easily removed when the replenishment chemical present in the filter 31 is exhausted. When used in or near a clean environment (such as a cleanroom), the isolation of the chemical in the cartridge significantly reduces the potential for introducing the chemical as a contaminant into the environment. The copper in the cartridge is only dissolved out of the cartridge when it reacts with the plating solution in the canister 29. Accordingly, the copper replenishment cartridge (also referred to as a filter cartridge) of the preferred embodiment is a significant improvement over the known technique of dumping copper containing chemicals into the plating solution.

Figure 4:
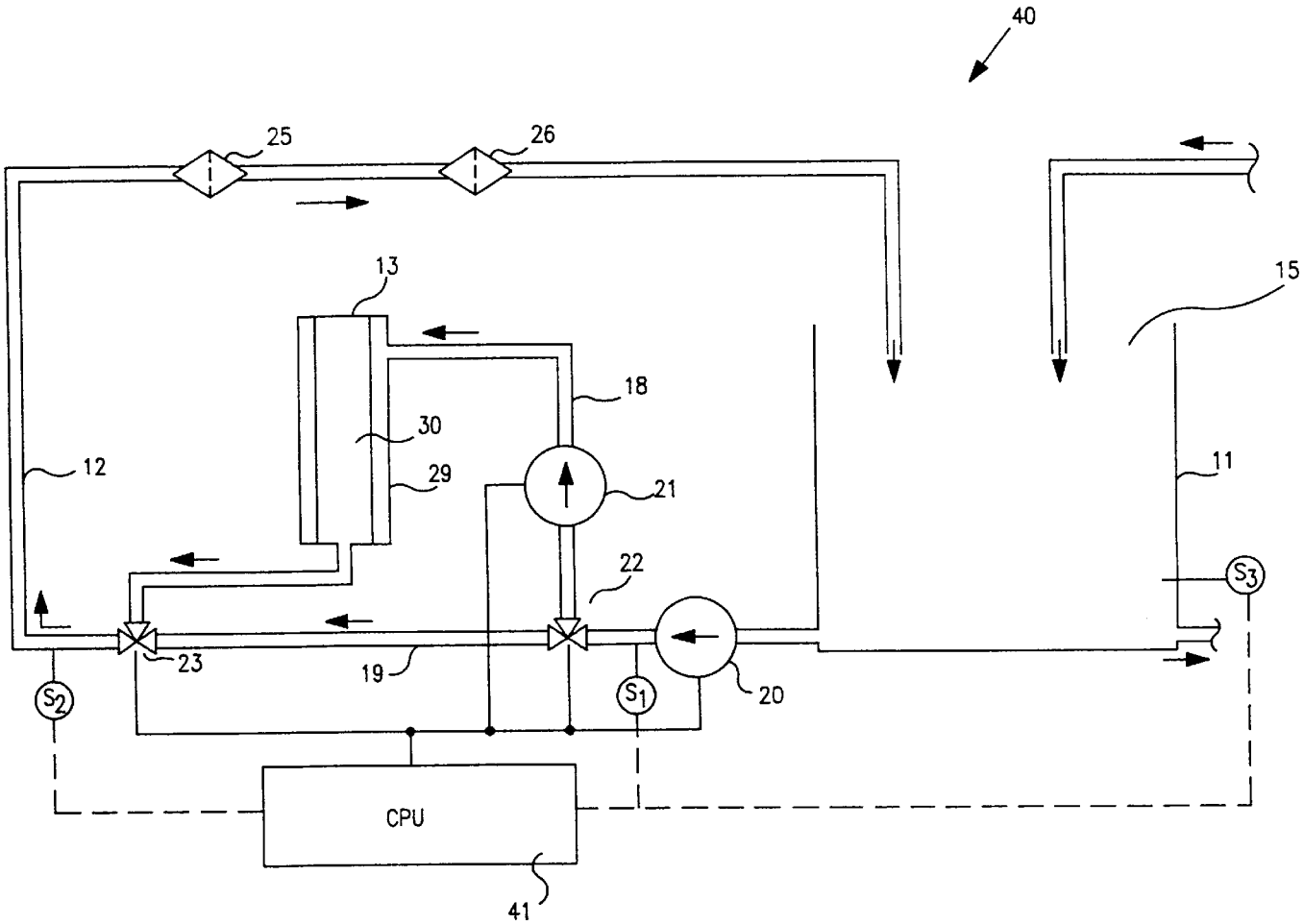
FIG. 4 is the plating replenishment system of FIG. 1, but now under processor control.

Referring to FIG. 4, an alternative copper replenishment system 40 is shown. System 40 is system 10 with the additional inclusion of a processor (such as a computer), which is identified as CPU 41. In system 40, the monitoring and control functions of the recirculation loop 12 are processor controlled. Accordingly, the sensors, pumps and valves are coupled to the CPU 41. The CPU 41 monitors the copper concentration level of the plating solution 15 and when copper replenishment is needed, inserts the replenishment path 18 into the system 40. Once appropriate copper levels have been restored, the replenishment path 18 is closed and the solution flow is through the bypass path 19. It is appreciated that the CPU 41 may be the same processing unit which is used to control the plating process, whether the plating is being performed in the vessel 11 or at some other location.

Thus, a copper replenishment system is described. It is appreciated that the present invention can be readily implemented for plating of other metals besides copper.

We claim:

1. An apparatus for replenishing a plating material removed from a solution used for plating comprising:

a vessel for holding the solution;

a replenishment container coupled to said vessel for receiving the solution and having the solution recirculated back into said vessel;

a cartridge inserted into said replenishment container for introducing the plating material back into the solution, said cartridge having a supporting outer structure for holding a chemical therein, the chemical when reacting with the solution replenishes the plating material removed from the solution.

2. The apparatus of claim 1 wherein the supporting outer structure of said cartridge is fabricated from a porous material to permit the solution to readily flow through, but retains the chemical in said cartridge, until the chemical reacts with the solution.

3. The apparatus of claim 1 further including a valve and a sensor, said sensor for monitoring a concentration of the plating material in the solution and said valve for controlling a flow of the solution to said replenishment container.

4. The apparatus of claim 3 further including a processor to monitor said sensor and activating or deactivating said valve to automatically regulate the concentration of the plating material in the solution in response to said sensor.

5. The apparatus of claim 1 wherein said plating material is comprised of copper.

6. The apparatus of claim 5 wherein the chemical is copper oxide, CuO.

7. The apparatus of claim 5 wherein the chemical is copper hydroxide, $Cu(OH)_2$.

8. An apparatus for replenishing copper removed from a copper plating solution used for plating copper onto a semiconductor wafer comprising:

a vessel for holding the plating solution;

a replenishment container coupled to said vessel for receiving the plating solution and having the plating solution recirculated back into said vessel;

a filter cartridge inserted into said replenishment container for introducing copper back into the plating solution, said filter cartridge having an supporting outer structure for holding a copper replenishing chemical therein, the copper replenishing chemical when reacting with the plating solution replenishes the copper removed from the solution.

9. The apparatus of claim 8 wherein the supporting outer structure of said filter cartridge is fabricated from a porous material to permit the plating solution to readily flow through, but retains the copper replenishing chemical, which is in powder form, in said filter cartridge, until the chemical reacts with the plating solution.

10. The apparatus of claim 8 further including a valve and a sensor, said sensor for monitoring a concentration of the copper in the plating solution and said valve for controlling a flow of the plating solution to said replenishment container.

11. The apparatus of claim 10 further including a processor to monitor said sensor and activating or deactivating said valve to automatically regulate the concentration of the copper in the plating solution in response to said sensor.

12. The apparatus of claim 9 wherein the copper replenishing chemical is copper oxide, CuO.

13. The apparatus of claim 9 wherein the copper replenishing chemical is copper hydroxide, $Cu(OH)_2$.

14. A method of replenishing a plating material removed from a plating solution used for plating, comprising the steps of:

pumping the plating solution from a vessel used for holding the plating solution to a replenishment container coupled to the vessel;

pumping the plating solution through a filter cartridge inserted into said replenishment container, the filter cartridge having a supporting outer structure for holding a chemical therein;

introducing the plating material back into the plating solution when the plating solution flows through the filter cartridge, the chemical when reacting with the solution replenishes the plating material removed from the solution recirculating the replenished plating solution back into the vessel.

15. The method of claim 14 wherein said step of pumping the plating solution through the filter cartridge, pumps the solution through a porous filter cartridge which permits the plating solution to readily flow through, but retains the chemical in the cartridge, until the chemical reacts with the plating solution.

16. The method of claim 14 further including a step of monitoring a concentration of the plating material in the plating solution and a further step of controlling a flow of the plating solution to the filter cartridge to regulate the amount of plating material being replenished into the plating solution.

17. The method of claim 16 further including the step of using a processor to monitor the concentration of the plating material in the plating solution and controlling the flow of the plating solution to the filter cartridge.

18. The method of claim 14 wherein the replenishing of the plating material is to replenish copper in the plating solution, which solution is used for plating copper.

19. The method of claim 18 wherein the chemical used to replenish the copper is copper oxide, CuO.

20. The method of claim 18 wherein the chemical used to replenish the copper is copper hydroxide, $Cu(OH)_2$.

21. A cartridge utilized for replenishing a plating material removed from a solution used for plating comprising:

an outer supporting structure formed from a filtering material for permitting plating liquid to flow therethrough;

a replenishing chemical residing therein, said replenishing chemical when reacting with the solution flowing through the filtering material introduces the plating material into the solution.

22. The cartridge of claim 21 wherein said outer supporting structure is comprised of a porous filter having a hollow core to permit the solution to readily flow through and said replenishing chemical is contained within said porous filter.

23. The cartridge of claim 22 wherein the replenishing chemical is copper oxide, CuO.

24. The cartridge of claim 22 wherein the replenishing chemical is copper hydroxide, $Cu(OH)_2$.

* * * * *

UNITED STATES PATENT AND TRADEMARK OFFICE

CERTIFICATE OF CORRECTION

PATENT NO. : 5,997,712
DATED : December 7, 1999
INVENTOR(S) : Chiu H. Ting, Peter Cho, Frank Lin, and Tanya Andryushchenko It is certified that error appears in the above-identified patent and that said Letters Patent is hereby corrected as shown below:

Column 4,
Line 48, "ad" should be -- and --.

Signed and Sealed this

Fifteenth Day of January, 2002

*Attest:*

*Attesting Officer*

JAMES E. ROGAN
*Director of the United States Patent and Trademark Office*